US007413508B2

(12) United States Patent
Nelson et al.

(10) Patent No.: US 7,413,508 B2
(45) Date of Patent: Aug. 19, 2008

(54) GAMING DEVICE HAVING A SELECTION AWARD REVEALING GAME

(75) Inventors: Dwayne Nelson, Las Vegas, NV (US); David Haag, Las Vegas, NV (US)

(73) Assignee: IGT, Reno, NV (US)

( * ) Notice: Subject to any disclaimer, the term of this patent is extended or adjusted under 35 U.S.C. 154(b) by 765 days.

(21) Appl. No.: 10/446,517

(22) Filed: May 28, 2003

(65) Prior Publication Data

US 2004/0242296 A1 Dec. 2, 2004

(51) Int. Cl.
*A63F 9/24* (2006.01)

(52) U.S. Cl. ..... 463/11; 463/20

(58) Field of Classification Search ..... 463/11
See application file for complete search history.

(56) References Cited

U.S. PATENT DOCUMENTS

| | | | | |
|---|---|---|---|---|
| 1,527,929 | A | 2/1925 | Simons | |
| 3,642,287 | A | 2/1972 | Lally et al. | |
| 4,182,515 | A | 1/1980 | Nemeth | |
| 4,560,161 | A | 12/1985 | Hamano | |
| 4,582,324 | A * | 4/1986 | Koza et al. | 463/16 |
| 4,695,053 | A | 9/1987 | Vazquez, Jr. et al. | |
| 4,775,155 | A | 10/1988 | Lees | |
| 5,042,809 | A * | 8/1991 | Richardson | 463/18 |
| 5,046,737 | A * | 9/1991 | Fienberg | 273/139 |
| 5,380,007 | A | 1/1995 | Travis et al. | |
| 5,411,271 | A * | 5/1995 | Mirando | 463/9 |
| 5,536,016 | A | 7/1996 | Thompson | |
| 5,542,669 | A | 8/1996 | Charron et al. | |
| 5,647,798 | A | 7/1997 | Falciglia | |
| 5,711,525 | A | 1/1998 | Breeding | |
| 5,743,524 | A | 4/1998 | Nannicola | |
| 5,823,873 | A | 10/1998 | Moody | |
| 5,833,536 | A | 11/1998 | Davids et al. | |
| 5,855,514 | A | 1/1999 | Kamille | |
| 6,015,346 | A | 1/2000 | Bennett | |
| 6,089,976 | A | 7/2000 | Schneider et al. | |
| 6,102,798 | A | 8/2000 | Bennett | |
| 6,110,041 | A | 8/2000 | Walker et al. | |

(Continued)

FOREIGN PATENT DOCUMENTS

EP 0 688 002 B1 12/1995

(Continued)

OTHER PUBLICATIONS

Clue Advertisement, written by Mikohn, published in 2002.

(Continued)

*Primary Examiner*—Xuan M. Thai
*Assistant Examiner*—Jasson H Yoo
(74) *Attorney, Agent, or Firm*—Bell, Boyd & Lloyd LLP

(57) ABSTRACT

A gaming device and method having a selection award revealing bonus game, where during the primary game the player is awarded indicators. The gaming device reveals the values associated with selections in the bonus game, and the bonus game is initiated upon the player accumulating a predetermined combination of indicators. The player is allowed to pick the selections which the associated values have been previously revealed to the player and the gaming device provides awards associated with the picked selections to the player.

5 Claims, 8 Drawing Sheets

U.S. PATENT DOCUMENTS

| | | | | |
|---|---|---|---|---|
| 6,146,273 | A | 11/2000 | Olsen | |
| 6,149,156 | A | 11/2000 | Feola | |
| 6,155,925 | A | 12/2000 | Giobbi et al. | |
| 6,159,097 | A | 12/2000 | Gura | |
| 6,159,098 | A | 12/2000 | Slomiany et al. | |
| 6,165,070 | A | 12/2000 | Nolte et al. | |
| 6,174,233 | B1 | 1/2001 | Sunaga et al. | |
| 6,174,235 | B1 | 1/2001 | Walker et al. | |
| 6,190,255 | B1 | 2/2001 | Thomas et al. | |
| 6,203,429 | B1 | 3/2001 | Demar et al. | |
| 6,231,442 | B1 | 5/2001 | Mayeroff | |
| 6,261,177 | B1 | 7/2001 | Bennett | |
| 6,302,790 | B1 | 10/2001 | Brossard | |
| 6,308,953 | B1 | 10/2001 | Nagano | |
| 6,309,300 | B1 | 10/2001 | Glavich | |
| 6,312,334 | B1 | 11/2001 | Yoseloff | |
| 6,315,664 | B1 | 11/2001 | Baerlocher et al. | |
| 6,319,124 | B1 | 11/2001 | Baerlocher et al. | |
| 6,322,309 | B1 | 11/2001 | Thomas et al. | |
| 6,346,043 | B1 | 2/2002 | Colin et al. | |
| 6,347,996 | B1 | 2/2002 | Gilmore et al. | |
| 6,375,187 | B1 | 4/2002 | Baerlocher et al. | |
| 6,398,644 | B1 | 6/2002 | Perrie et al. | |
| 6,413,160 | B1 | 7/2002 | Vancura | |
| 6,435,511 | B1 | 8/2002 | Vancura et al. | |
| 6,439,995 | B1 | 8/2002 | Hughs-Baird et al. | |
| 6,443,837 | B1 | 9/2002 | Jaffe et al. | |
| 6,464,582 | B1 | 10/2002 | Baerlocher et al. | |
| 6,506,118 | B1 | 1/2003 | Baerlocher et al. | |
| 6,514,141 | B1 | 2/2003 | Kaminkow et al. | |
| 6,572,471 | B1 * | 6/2003 | Bennett | 463/16 |
| 6,575,830 | B2 | 6/2003 | Baerlocher et al. | |
| 6,602,137 | B2 | 8/2003 | Kaminkow et al. | |
| 6,607,438 | B2 | 8/2003 | Baerlocher et al. | |
| 6,609,974 | B2 | 8/2003 | Mead et al. | |
| 6,632,141 | B2 | 10/2003 | Webb et al. | |
| 6,648,754 | B2 | 11/2003 | Baerlocher et al. | |
| 6,666,765 | B2 | 12/2003 | Vancua | |
| 6,692,005 | B2 | 2/2004 | Vancura et al. | |
| 6,733,386 | B2 | 5/2004 | Cuddy et al. | |
| 2002/0142822 | A1 | 10/2002 | Baerlocher et al. | |
| 2002/0183109 | A1 | 12/2002 | McGahn et al. | |
| 2003/0027623 | A1 | 2/2003 | Rose | |
| 2003/0040360 | A1 * | 2/2003 | Kaminkow | 463/25 |
| 2003/0078093 | A1 | 4/2003 | Simms et al. | |
| 2003/0078096 | A1 | 4/2003 | Kaminkow et al. | |
| 2003/0119580 | A1 | 6/2003 | McClintic et al. | |
| 2003/0119583 | A1 | 6/2003 | Kaminkow et al. | |
| 2003/0157979 | A1 | 8/2003 | Cannon et al. | |
| 2003/0162584 | A1 | 8/2003 | Hughs-Baird et al. | |
| 2003/0216167 | A1 * | 11/2003 | Gauselmann | 463/25 |

FOREIGN PATENT DOCUMENTS

| | | | |
|---|---|---|---|
| EP | 0 945 837 | A2 | 9/1999 |
| EP | 0 984 409 | A2 | 3/2000 |
| GB | 2 144 644 | A | 8/1983 |
| WO | WO 03026759 | | 4/2003 |

OTHER PUBLICATIONS

Clue—Most Wanted Brochure, written by Mikohn, published in 2003.

Clue Unusual Suspects Brochure, written by Mikohn, published in 2003.

Trivial Pursuit Game Brochure, written by Mikohn, published in 2003.

Slot Toppers Article, written by Strictly Slots, published in Dec. 2000.

Battleship All Aboard Article, written by Mikohn, published in Sep. 2000.

* cited by examiner

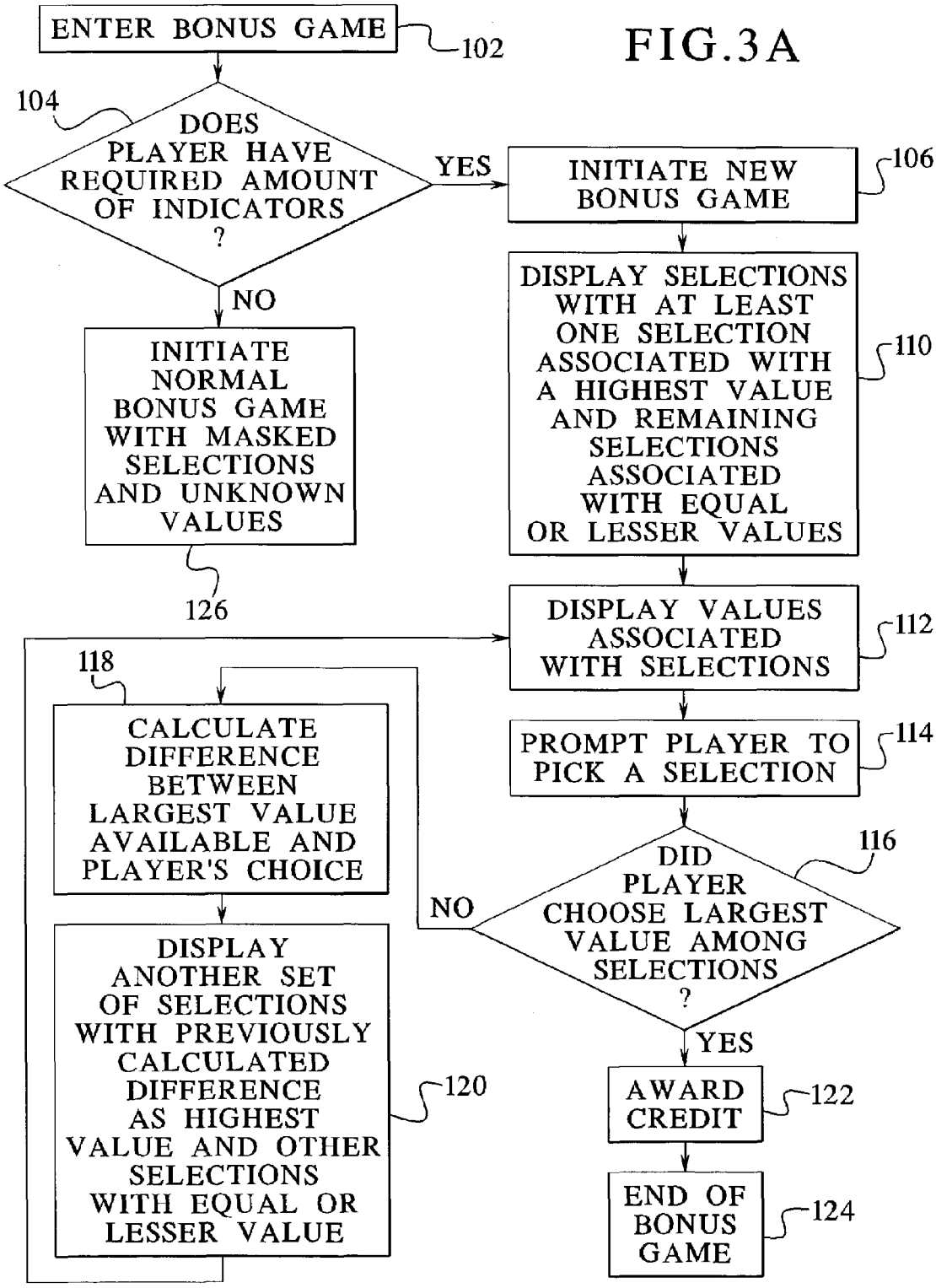
ENTER BONUS GAME
102
FIG.3A
104
DOES PLAYER HAVE REQUIRED AMOUNT OF INDICATORS ?
YES
NO
INITIATE NEW BONUS GAME
106
DISPLAY SELECTIONS WITH AT LEAST ONE SELECTION ASSOCIATED WITH A HIGHEST VALUE AND REMAINING SELECTIONS ASSOCIATED WITH EQUAL OR LESSER VALUES
110
INITIATE NORMAL BONUS GAME WITH MASKED SELECTIONS AND UNKNOWN VALUES
126
DISPLAY VALUES ASSOCIATED WITH SELECTIONS
112
118
CALCULATE DIFFERENCE BETWEEN LARGEST VALUE AVAILABLE AND PLAYER'S CHOICE
PROMPT PLAYER TO PICK A SELECTION
114
116
DID PLAYER CHOOSE LARGEST VALUE AMONG SELECTIONS ?
NO
YES
DISPLAY ANOTHER SET OF SELECTIONS WITH PREVIOUSLY CALCULATED DIFFERENCE AS HIGHEST VALUE AND OTHER SELECTIONS WITH EQUAL OR LESSER VALUE
120
AWARD CREDIT
122
END OF BONUS GAME
124

GAMING DEVICE HAVING A SELECTION AWARD REVEALING GAME

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device with a selection award revealing game.

BACKGROUND OF THE INVENTION

Gaming machines currently exist with mechanical or video reels having symbols thereon and bonus games in which a player has one or more opportunities to choose one or more particular symbols from a group of masked symbols. After the player selects a symbol, the game removes the mask and either awards the player with a bonus value or terminates the bonus round with a bonus terminator. The outcome depends upon whether the player selects an award or a bonus game terminator.

In the above game, the controller of the gaming device randomly places a predetermined number of masked awards and terminators in a pattern at the beginning of the bonus round and maintains the positioning until the bonus round terminates. When the player receives the value of the award, the game typically displays a message that the player may continue and enables the player to select another masked award, and the process continues until the player selects a masked terminator.

Since players seek more entertainment and enjoyment, it is therefore desirable to provide players with gaming devices with new and different bonus games.

SUMMARY OF THE INVENTION

The present invention provides a gaming device which includes a selection award revealing game. The game of the present invention reveals one or more or all of the values associated with masked bonus game symbols to a player before the player makes a selection. This enables the player to select the best selection or pick the symbol with the largest award or value. In one embodiment, the gaming device causes the player to believe that it is broken. This function may also be alternatively or randomly used so that the player does not know this will happen during every bonus game. This makes the player feel like the player has an advantage because the gaming device is revealing the value or values of the masked selections to the player possibly because the gaming device is making a mistake or is broken. Accordingly, the present invention may be implemented in any suitable desired fashion. It should also be appreciated that other awards, such as multipliers, may also be associated with the masked selections.

One alternative embodiment of the present invention includes a primary game which provides a player with indicators during the course of the primary game when predetermined game conditions are met. In one such embodiment, in a slot game, the game condition may occur when a predetermined symbol or combination of gaming symbols are displayed on certain paylines. It should be appreciated that the indicators can be displayed on the display device as they are accumulated or may be hidden from the player. When the player enters the secondary game, the controller determines if the player has acquired the appropriate indicators to implement the revealing feature. If the player has acquired the appropriate indicators, the game reveals or temporarily reveals the value associated with each of one or more or all of the symbols or selections which are in the bonus game prior to enabling the player to pick the selections. In another embodiment of the present invention, the game reveals the selection with the highest value that the player can pick. This allows the player to know and select the maximum award. Alternatively, additional masked symbols, may also be revealed. Without the appropriate indicators, the game does not reveal the values associated with the masked symbols or selections until after the player picks the selection or selections. It should be appreciated that not all of the awards associated with the selections have to be revealed.

In one embodiment, if after the game reveals the maximum value or award or a plurality of the values or award including the maximum value or award and the player does not choose the selection with the highest value or award associated with it, the gaming device re-reveals the previously revealed values or award, or alternatively provides information such as an animation to show the player the selections associated with the highest value and allows the player to pick again. In another embodiment, the controller determines the highest value the player could have picked and calculates the difference between that highest value and what the player actually picked. The game may simply provide this difference to the player or may provide another round with selections. The highest value of this additional bonus round is the difference the controller earlier calculated. The values of the selections are shown to the player and the player is allowed to pick again. This continues until the player is provided the highest value of the selection in the first group of selections. Accordingly, it should be appreciated that the present invention may be adapted to ensure that the player obtains the maximum award possible for a group of selections.

In one embodiment of the present invention, the player is able to pick more than one selection associated with a value or an award. In an embodiment which has values associated with the selections, the players may pick more than one selection and is provided with the sum of the values associated with the picked selections. It should be appreciated that the awards associated with the selections may include other awards, such as multipliers, as well as values, such as multipliers. In one embodiment of the present invention, a player who is able to pick more than one selection may be provided with a number of different awards associated with a number of selections.

In another embodiment of the present invention, the values associated with the masked selections are revealed throughout the primary game when triggering conditions occur. The player, however, still cannot pick the selections until the bonus game is initiated. The bonus game is initiated when the player acquires a predetermined number of indicators and/or achieves a qualifying condition.

In another embodiment of the invention, the masked selections are associated with the indicators. Upon an award of an indicator in the primary game, a selection that is associated with that indicator is displayed to the player. The value or award associated with that selection is also revealed upon the indicator being granted and the associated selection being display. The player, however, still cannot pick the selections until the bonus game is initiated. The bonus game is initiated when the player acquires a predetermined number of indicators and achieves a qualifying condition.

The game may also display the highest award and a number of lower awards or different types of awards associated with the selections, so that the player may know a number of awards, range of awards or the different types of awards associated with the selections. In one embodiment of the present invention, the game grants indicators to the player when a triggering event or indicator trigger is reached. The game accumulates the indicators and displays a plurality of selections when a predetermined combination of the indicators is reached. The game also displays the largest award and one or more lesser awards which are associated with the selections. The game reveals one or more of the awards associated with the selections. The player knows which award associated with the selections is the highest and can, thus, easily pick the associated with the highest award. The game provides the player with the highest award.

It should be appreciated that the present invention may be employed in a base or primary game as well as in a bonus or secondary game.

In another embodiment of the present invention, the values associated with the selections are determined from the gaming machine's paytables and displayed along with randomly chosen lower values.

In another embodiment of the present invention, multiple selections are associated with the highest value in the bonus game.

In another embodiment of the present invention, there are no indicators and the bonus game is initiated when a triggering event occurs.

In another embodiment of the present invention, the bonus game is initiated when a bonus game trigger occurs.

It is therefore an advantage of the present invention to provide a gaming device having a selection award revealing game.

It is an advantage of the present invention to provide a player a new bonus game where the player knows the values associated with masked symbols prior to symbol selection.

Other features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIGS. 3A and 3B are flow diagrams of alternative embodiments of the bonus game of the present invention utilizing indicators and ensuring the player receives the highest value in the new revealing, alternative bonus selection game.

DETAILED DESCRIPTION OF THE INVENTION

Figure 1A:
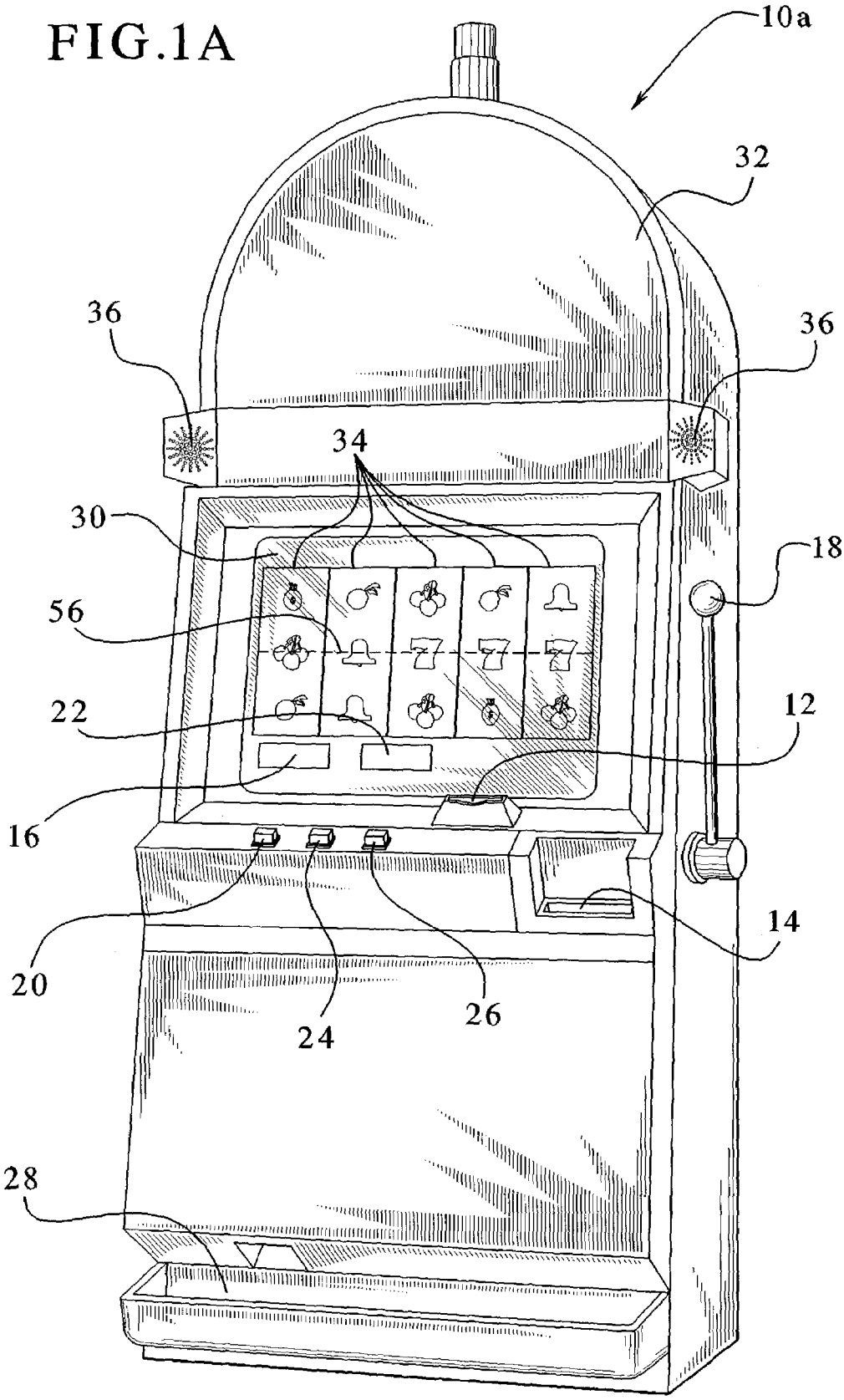
FIGS. 1A and 1B are front plan views of alternative embodiments of the gaming device of the present invention.
Figure 1B:
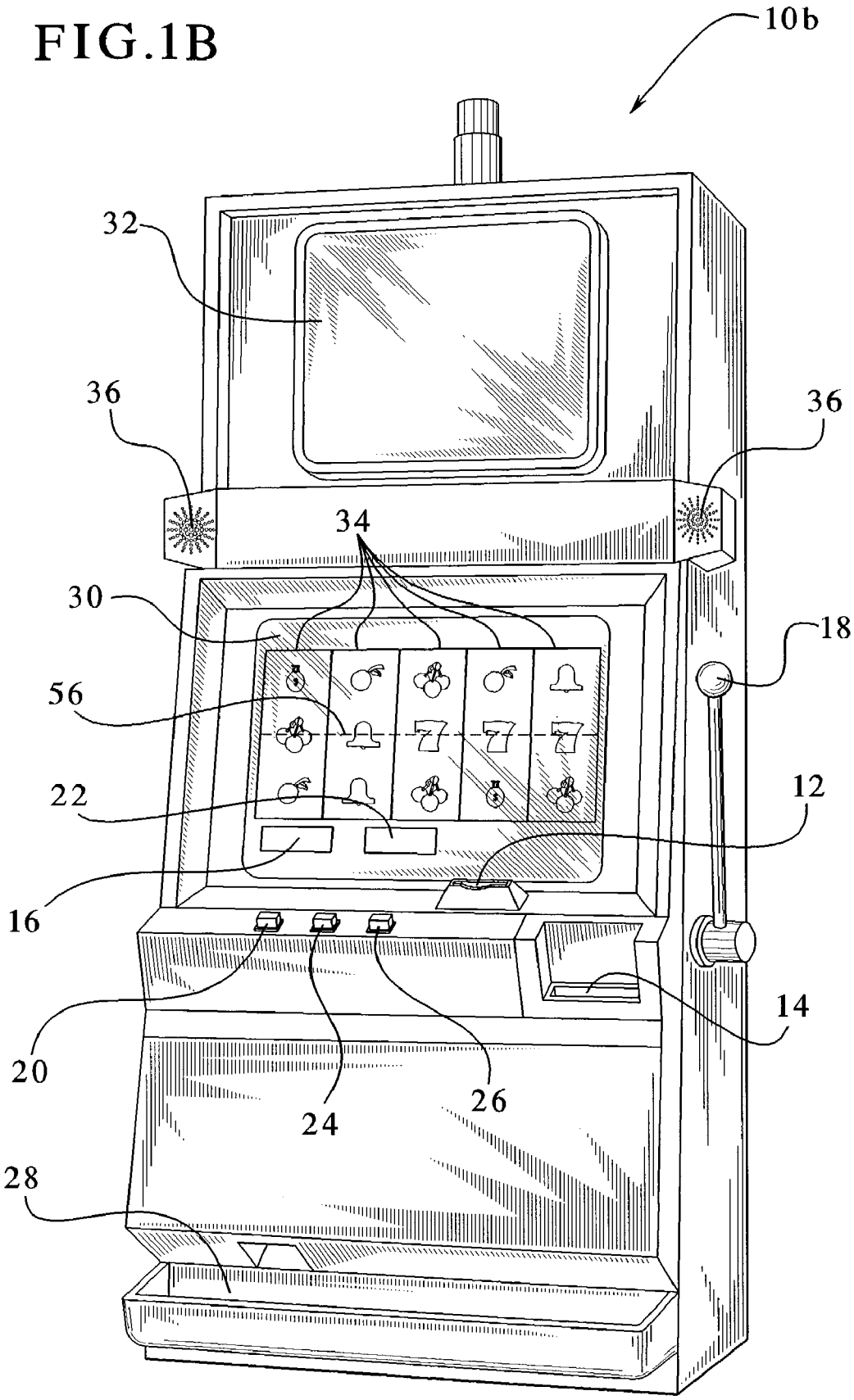

Referring now to the drawings, and in particular to FIGS. 1A and 1B, gaming device 10*a* and gaming device 10*b* illustrate two possible cabinet styles and display arrangements and are collectively referred to herein as gaming device 10. The present invention includes the game (described below) preferably being a bonus or secondary game that coordinates with a base game. When the game of the present invention is a bonus game, gaming device 10 in one base game is a slot machine having the controls, displays and features of a conventional slot machine, wherein the player operates the gaming device while standing or sitting. Gaming device 10 also includes being a pub-style or table-top game (not shown), which a player operates while sitting.

The base games of the gaming device 10 may include slot, poker, blackjack or keno, among others. The gaming device 10 also embodies any suitable bonus triggering events, bonus games as well as any suitable progressive game coordinating with these base games. The symbols and indicia used for any of the base, bonus and progressive games include mechanical, electrical or video symbols and indicia.

In a stand alone or a bonus embodiment, the gaming device 10 includes monetary input devices. FIGS. 1A and 1B illustrate a coin slot 12 for coins or tokens and/or a payment acceptor 14 for cash money. The payment acceptor 14 also includes other devices for accepting payment, such as readers or validators for credit cards, debit cards or smart cards, tickets, notes, etc. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. A player may cash out by pushing a cash out button 26 to receive coins or tokens in the coin payout tray 28 or other forms of payment, such as an amount printed on a ticket or credited to a credit card, debit card or smart card. Well known ticket printing and card reading machines (not illustrated) are commercially available.

Gaming device 10 also includes one or more display devices. The embodiment shown in FIG. 1A includes a central display device 30, and the alternative embodiment shown in FIG. 1B includes a central display device 30 as well as an upper display device 32. The display devices display any visual representation or exhibition, including but not limited to movement of physical objects such as mechanical reels and wheels, dynamic lighting and video images. The display device includes any viewing surface such as glass, a video monitor or screen, a liquid crystal display or any other static or dynamic display mechanism. In a video poker, blackjack or other card gaming machine embodiment, the display device includes displaying one or more cards. In a keno embodiment, the display device includes displaying numbers.

The slot machine base game of gaming device 10 preferably displays a plurality of reels 34, preferably three to five reels 34, in mechanical or video form on one or more of the display devices. Each reel 34 displays a plurality of indicia such as bells, hearts, fruits, numbers, letters, bars or other images which preferably correspond to a theme associated with the gaming device 10. If the reels 34 are in video form, the display device displaying the video reels 34 is preferably a video monitor. Each base game, especially in the slot machine base game of the gaming device 10, includes speakers 36 for making sounds or playing music.

Figure 2:
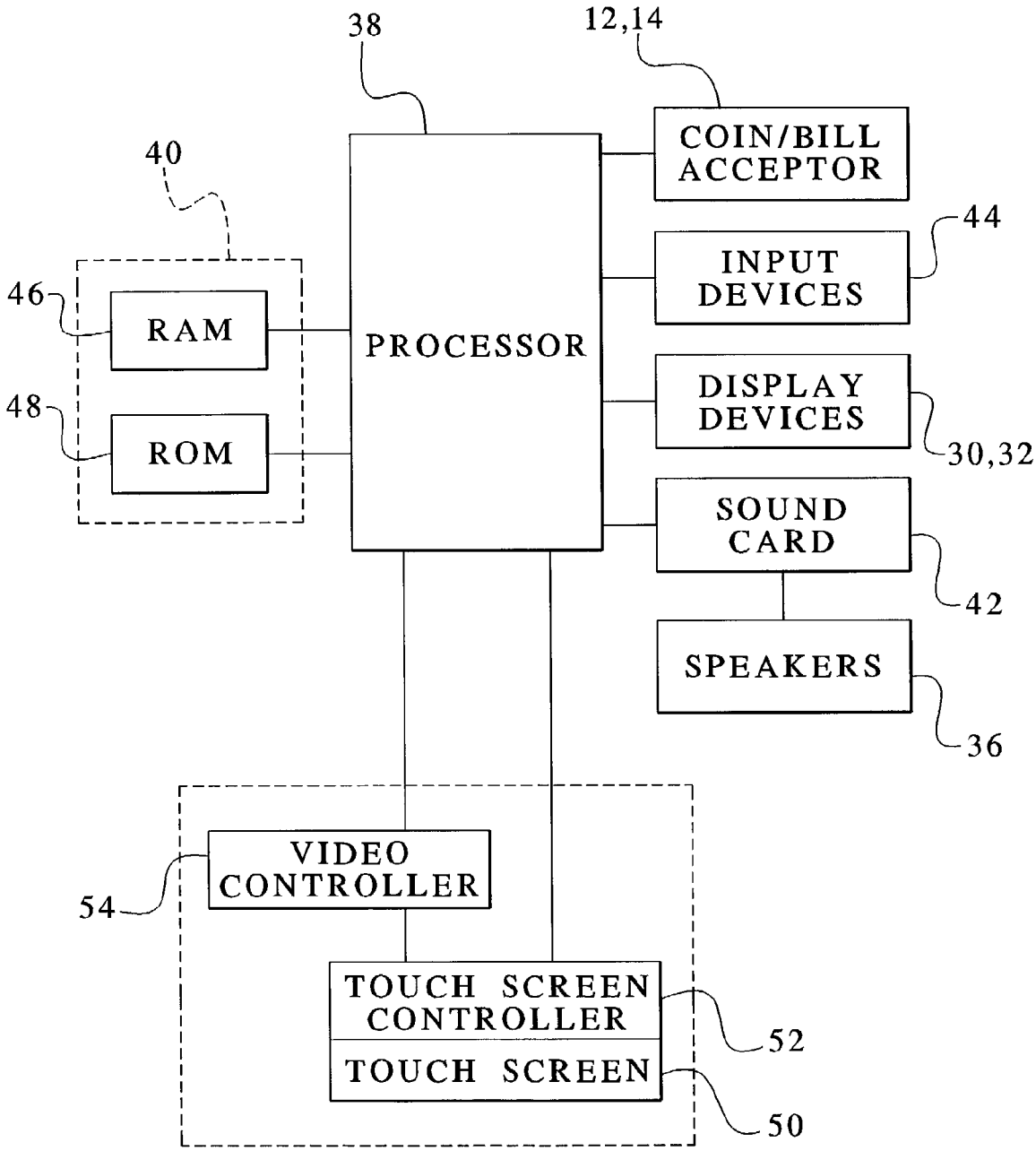
FIG. 2. is a schematic block diagram of the electronic configuration of one embodiment of the gaming device.

Referring now to FIG. 2, a general electronic configuration of the gaming device 10 for the stand alone and bonus embodiments described above preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 includes random access memory (RAM) 46 for storing event data or other data generated or used during a particular game. The memory device 40 also includes read only memory (ROM) 48 for storing program code, which controls the gaming device 10 so that it plays a particular game in accordance with applicable game rules and pay tables.

As illustrated in FIG. 2, the player preferably uses the input devices 44 to input signals into gaming device 10. In the slot machine base game, the input devices 44 include the pull arm 18, play button 20, the bet one button 24 and the cash out button 26. A touch screen 50 and touch screen controller 52 are connected to a video controller 54 and processor 38. The terms "computer" or "controller" are used herein to refer collectively to the processor 38, the memory device 40, the sound card 42, the touch screen controller and the video controller 54.

In certain instances, it is preferable to use a touch screen 50 and an associated touch screen controller 52 instead of a conventional video monitor display device. The touch screen enables a player to input decisions into the gaming device 10 by sending a discrete signal based on the area of the touch screen 50 that the player touches or presses. As further illustrated in FIG. 2, the processor 38 connects to the coin slot 12 or payment acceptor 14, whereby the processor 38 requires a player to deposit a certain amount of money in to start the game.

It should be appreciated that although a processor 38 and memory device 40 are preferable implementations of the present invention, the present invention also includes being implemented via one or more application-specific integrated circuits (ASIC's), one or more hard-wired devices, or one or more mechanical devices (collectively or alternatively referred to herein as a "processor"). Furthermore, although the processor 38 and memory device 40 preferably reside in each gaming device 10 unit, the present invention includes providing some or all of their functions at a central location such as a network server for communication to a playing station such as over a local area network (LAN), wide area network (WAN), Internet connection, microwave link, and the like.

With reference to the slot machine base game of FIGS. 1A and 1B, to operate the gaming device 10, the player inserts the appropriate amount of tokens or money in the coin slot 12 or the payment acceptor 14 and then pulls the arm 18 or pushes the play button 20. The reels 34 then begin to spin. Eventually, the reels 34 come to a stop. As long as the player has credits remaining, the player can spin the reels 34 again. Depending upon where the reels 34 stop, the player may or may not win additional credits.

In addition to winning base game credits, the gaming device 10, including any of the base games disclosed above, also includes bonus games that give players the opportunity to win credits. The gaming device 10 preferably employs a video-based display device 30 or 32 for the bonus games. The bonus games include a program that automatically begins when the player achieves a qualifying condition in the base game.

In the slot machine embodiment, the qualifying condition includes a particular symbol or symbol combination generated on a display device. As illustrated in the five reel slot game shown in FIGS. 1A and 1B, the qualifying condition includes the number seven appearing on three adjacent reels 34 along a payline 56. It should be appreciated that the present invention includes one or more paylines, such as payline 56, wherein the paylines can be horizontal, diagonal or any combination thereof.

BONUS GAME

If a player achieves a bonus game trigger or qualifying condition during the primary or base game, the gaming device 10 automatically initiates the bonus round of the present invention.

In one embodiment of the present invention, indicators are awarded during the primary game when a player achieves an indicator trigger or predetermined condition. These indicators are displayed on the display devices 30, 32 as they are accumulated during the primary game. If the player acquires the required amount of indicators, the values associated with a plurality of masked selections in the bonus game will be revealed.

In another embodiment, the gaming device 10 will reveal only some of the values associated with the masked selections. In yet another embodiment, the gaming device 10 will always reveal at least the highest value associated with the group of values associated with the masked selections.

One embodiment of the bonus game is illustrated in FIG. 3A. The controller determines if the player has accumulated the required amount of indicators as indicated by block 104. If the player has accumulated the required amount of indicators, the bonus game embodied in the present invention is initiated as indicated by block 106. The gaming device 10 displays a plurality of symbols or selections associated with the bonus game. The predetermined or randomly determined values are associated with the symbols or selections, but not revealed to the player. At least one of the values is the highest value and the other values in the bonus game are of equal or lesser value as indicated by block 110.

Figure 4A:
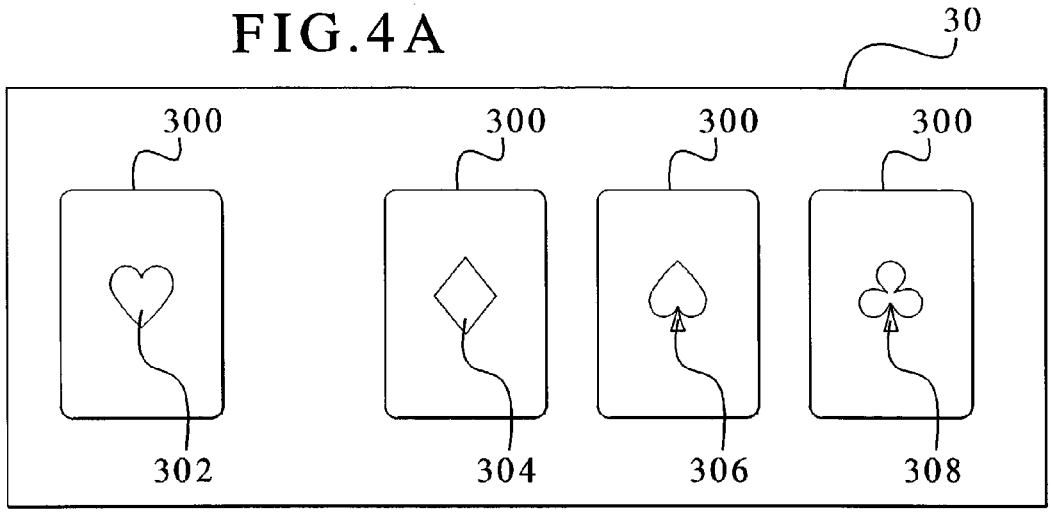
FIGS. 4A, 4B and 4C are front plan views of an embodiment of the displays of a bonus game utilizing a method of revealing the values associated with selections in a bonus game.
Figure 4B:
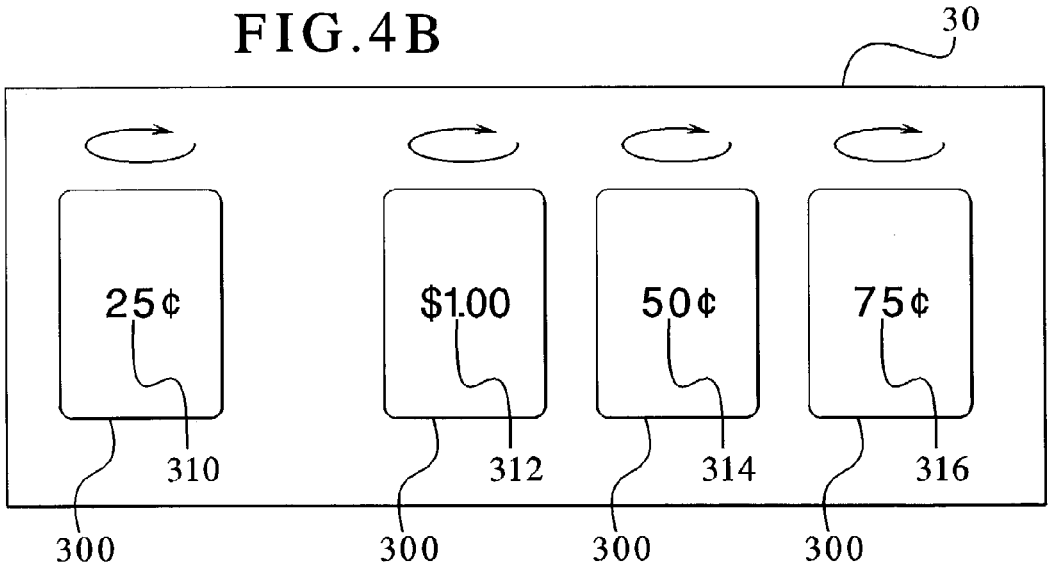
Figure 4C:
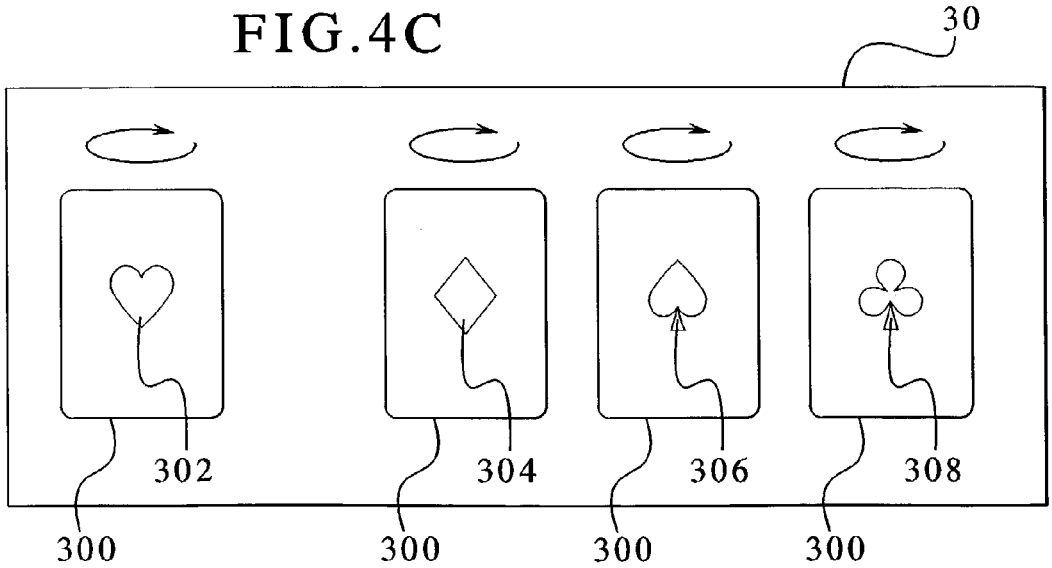

The symbols or selections can be arranged in any suitable manner such as in the manner depicted in FIG. 4A, where the selections are in the form of cards 300 and each card 300 is associated with a symbol to differentiate between the cards 300. In this illustrated embodiment, the symbols are a heart 302, a diamond 304, a spade 306 and a club 308. The values associated with the selections in the bonus game are displayed to the player as indicated by block 112. The values can be revealed by utilizing an animation or in any other suitable manner. In one embodiment, the playing cards 300 displayed on the display device 30 rotate to show the values 310, 312, 314, and 316 which are masked by the selections, and rotate again to mask the values as illustrated in FIGS. 4A, 4B and 4C. The player is prompted to pick a selection as indicated by block 114. In this embodiment, the controller determines if the player picked the selection with the largest value as indicated by block 116. If the player selects the selection with the largest value, the player is awarded credit as indicated by block 122 and the bonus game is completed as indicated by block 124.

In this embodiment, if the player did not choose the selection with the largest value, the controller calculates the difference between the largest value among the available selections and the player's pick as indicated by block 118. The game may also simply provide this difference to the player as an additional bonus or may alternatively provide another set of selections on the display device 30 wherein at least one of the values associated with these selections is the calculated difference as indicated by block 120. The values associated with the selections are revealed again as indicated by block 112 on the display device 30 and the player is allowed to pick again.

In another embodiment of the present invention, if the player did not selection a masked selection associated with the highest value, the controller cancels the player's pick, reveals the values of the selections and allows the player to pick again.

Figure 3B:
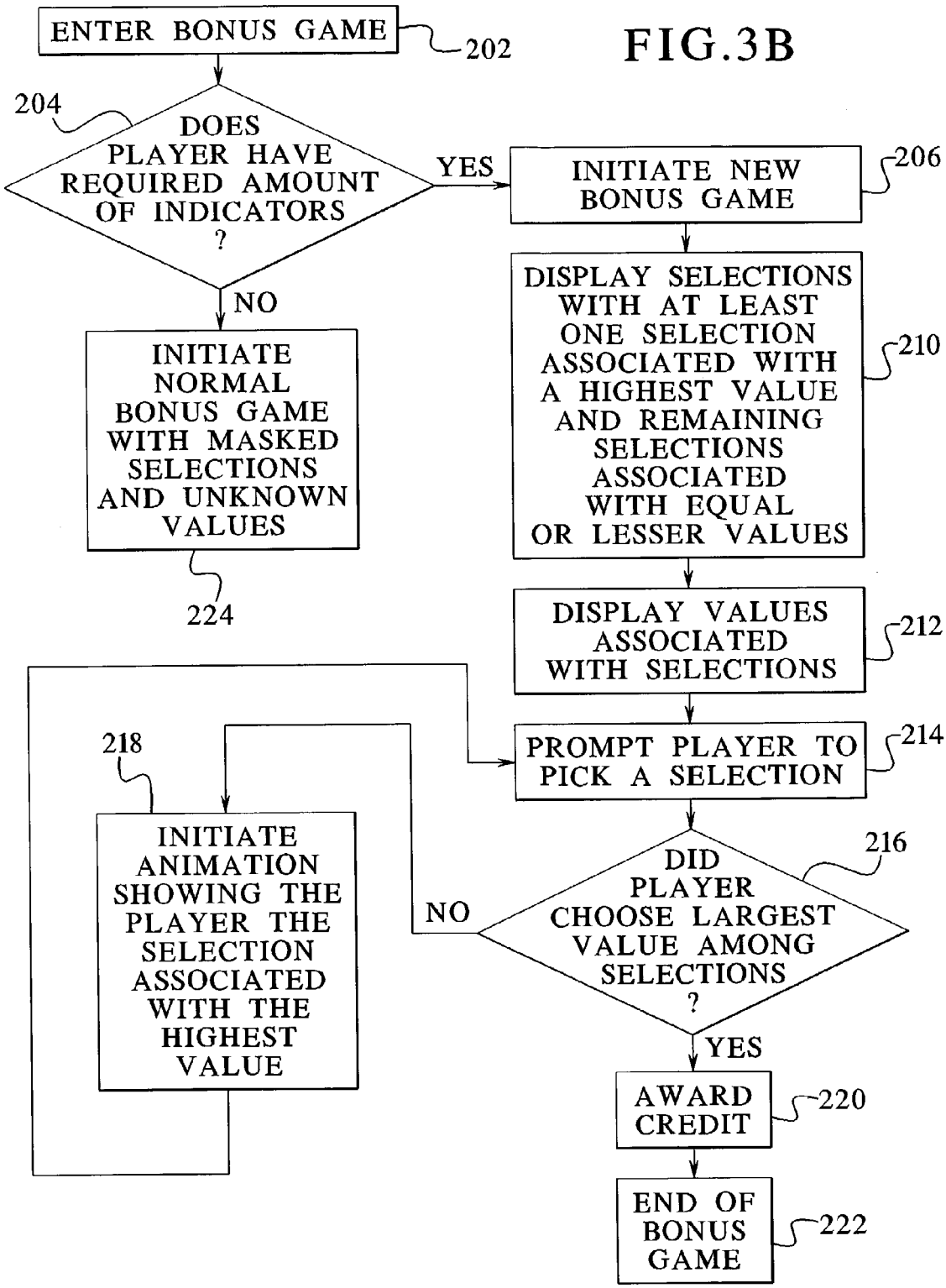
Figure 5:
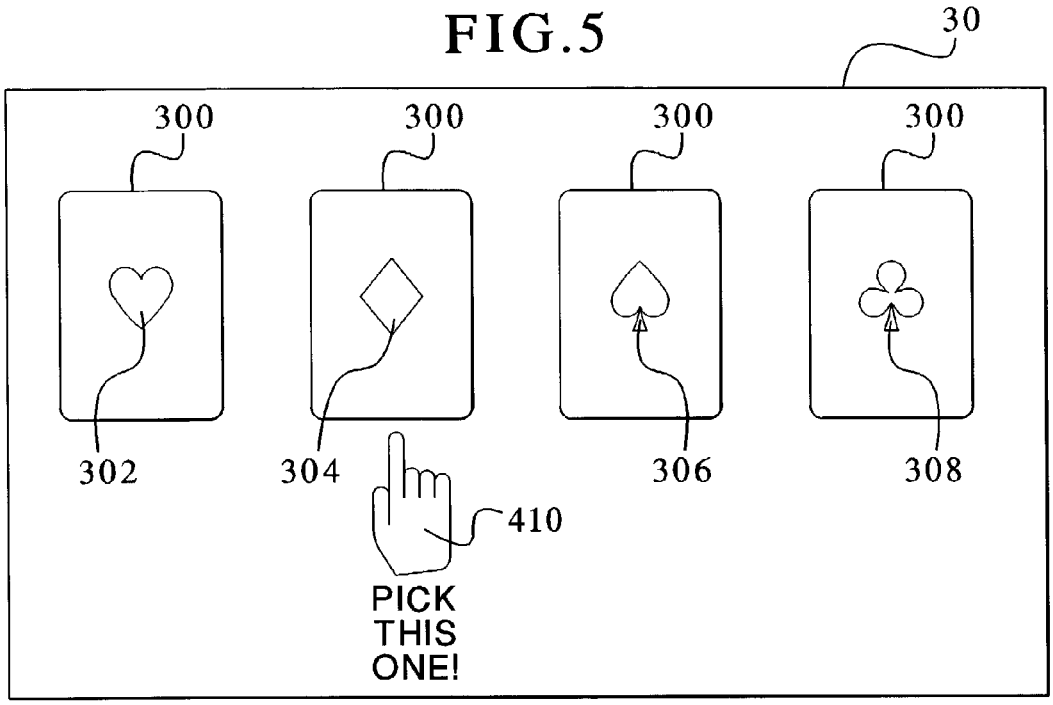
FIG. 5 is a front plan view of an embodiment of the display of a bonus game utilizing animation to ensure that the player picks the selection with the highest value.

Another embodiment of the method of the present invention is illustrated in FIG. 3B. During the bonus game, the symbols or selections are displayed. The values associated with each selection are revealed on the display device 30. The player is prompted to pick a selection as indicated by block 212. The controller determines if the player picked the selection that has the highest value associated with it as indicated by block 216. If the player chose the selection with the highest value, the player is awarded credit as indicated by block 220. If the player did not choose the selection with the highest value, the gaming device 10 initiates an animation on the display device 30 which shows the player the selection with the highest value as indicated by block 218. One embodiment of the present invention utilizes animation displayed on the display device 30 showing a hand 410 as depicted in FIG. 5 pointing to the selection 404 with the highest value.

Figure 6:
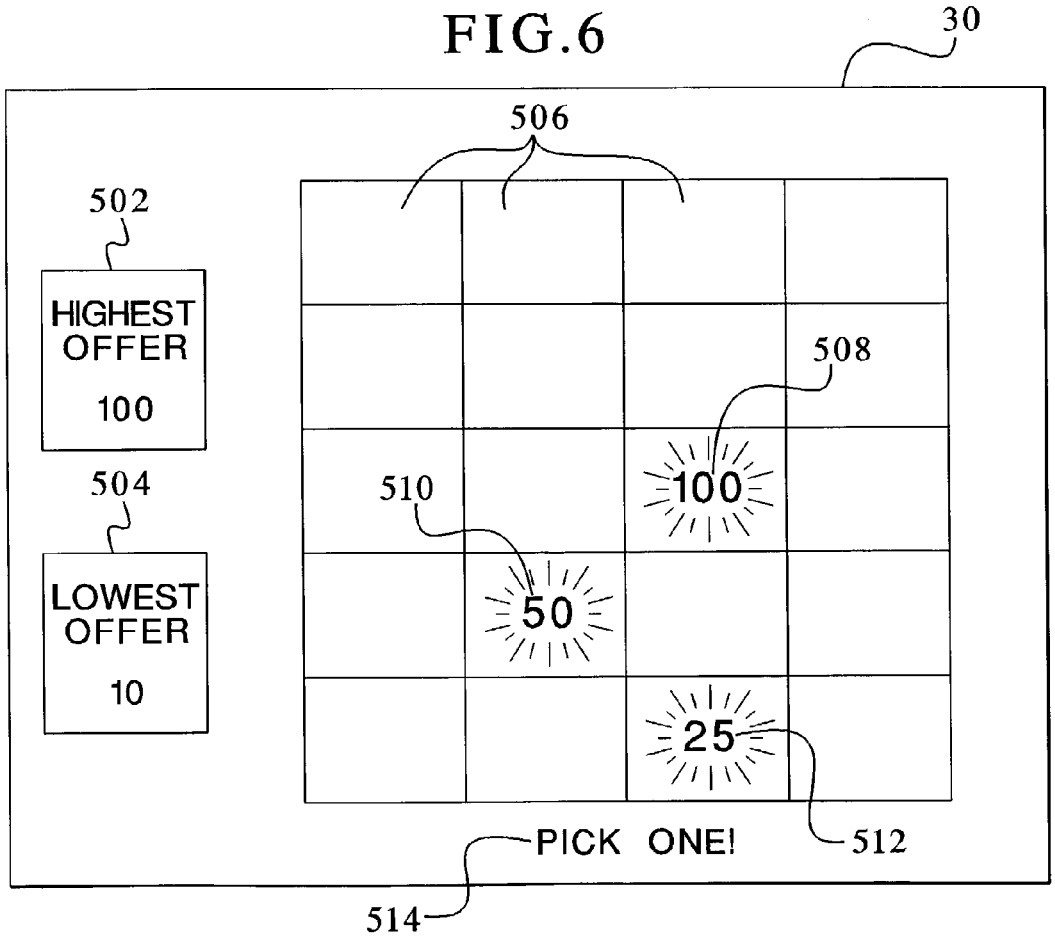
FIG. 6 is a front plan view of an embodiment of the display of a bonus game utilizing a number of masked selections revealing their values among a plurality of masked selections.

Another embodiment of the present invention is depicted in FIG. 6. During the bonus game a plurality of masked selections 506 are displayed. At least one of the values associated with the selections is the highest value available for that particular bonus round and the other values being of equal or lesser value. The highest value 502 and lowest value 504 offered to the player in that bonus round are revealed to the player. A plurality of selection's values 508, 510, 512 are revealed to the player. At least one of the values 508 revealed is the highest value available to the player for that bonus round. The player is prompted 514 to make a selection and the player is awarded the value of the chosen selection.

In another embodiment of the present invention, the gaming device initiates the bonus round upon the occurrence of a bonus round trigger. In the base game, indicators are provided to the player upon the occurrence of at least one indicator trigger. The indicators provided to the player are accumulated. In the bonus round, the display device 30 reveals a number of masked selections and the player picks at least one masked selection. At least one award or value which is associated with the picked masked selections is provided to the player. In this embodiment, the awards or values associated with the masked selection are only revealed to the player when the player has accumulated a predetermined combination of indicators. If the player has acquired the predetermined combination of indicators, the awards or values are revealed to the player before the player can pick any of the masked selections so that the player knows the associations between the awards and the masked selections.

It should be appreciated that a player in one embodiment of the present invention can pick more than one selection with an associated value and the player would be provided with the sum of the associated values or an award based on such values.

It should also be appreciated that awards other than values, such as multipliers, can also be associated with the masked selections instead of values.

It should be appreciated that the bonus game of the present invention does not have to ensure that a player chooses the selection with the highest value. The gaming device can ensure that the player receives at least one predetermined value.

It should be appreciated that the values associated with the selections in the bonus game of the present invention do not have to be revealed through the use of visual devices, and can be revealed utilizing an audio production or a combination of both an audio and visual production.

In another embodiment of the present invention, the player in the primary game reaches a triggering event or qualifying condition and the display device 30 displays a selection and reveals the value associated with the selection during the primary game. The selection is then used in the bonus game if the player acquires the required amount of indicators during the primary game and achieves a qualifying condition.

Figure 7A:
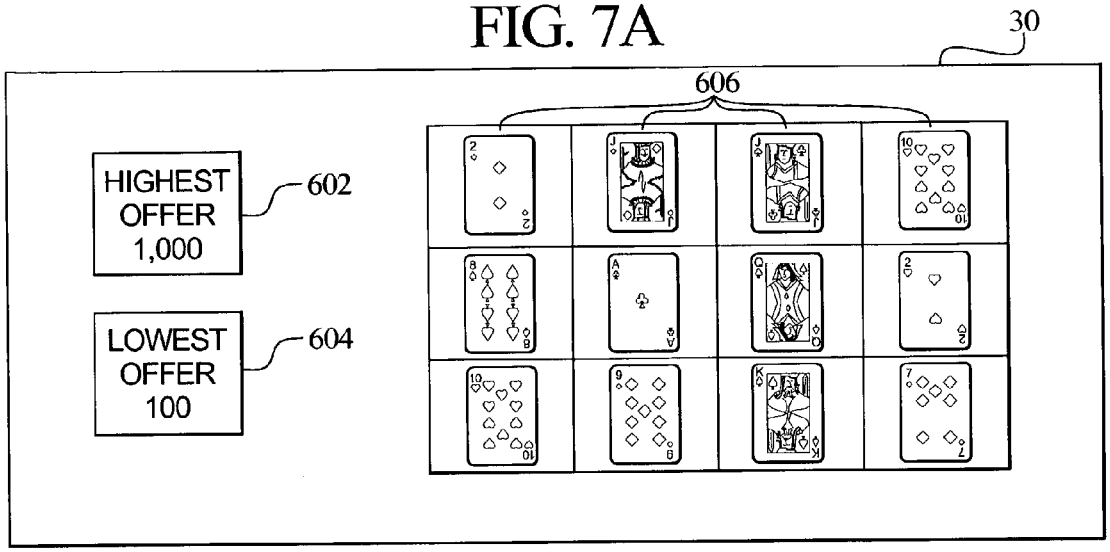
FIGS. 7A, 7B, and 7C are front plan views of an embodiment of the display of a bonus game utilizing a method of revealing the values associated with selections in a bonus game.
Figure 7B:
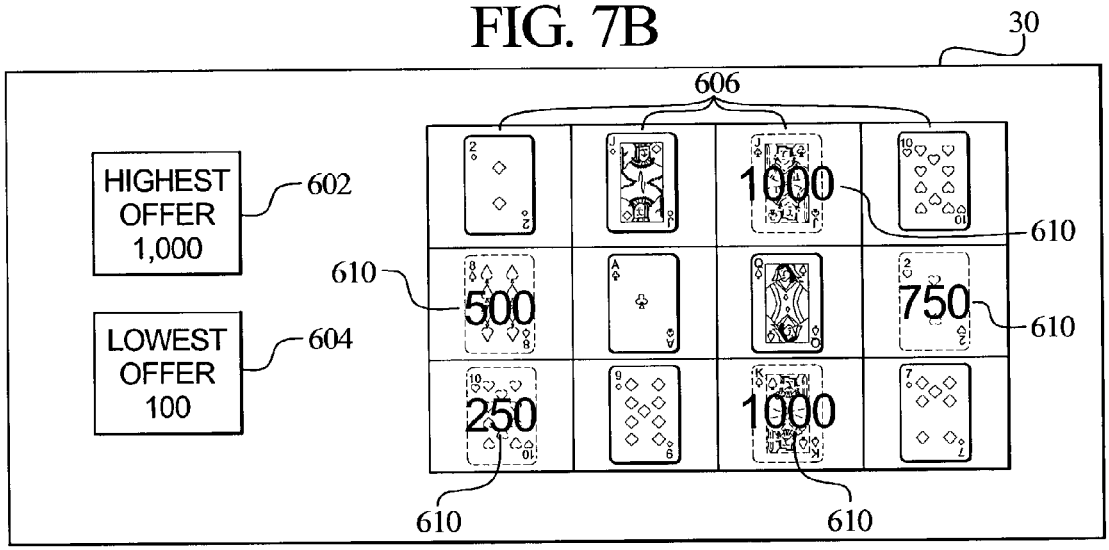
Figure 7C:
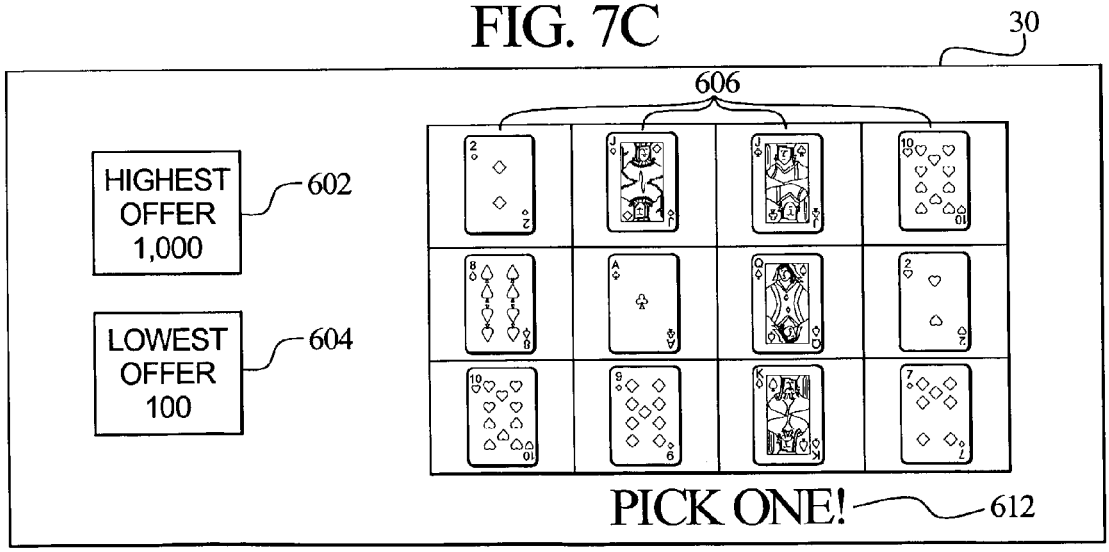

In another embodiment of the present invention, the values of the selections are revealed in a manner such that the gaming machine 10 gives the illusion that it is broken and mistakenly reveals the values of the selections in the bonus game. The production may utilize the gaming device 10 vibrating, blinking lights, animation and an audio production. This function may also be alternatively or randomly used so that the player does not know this will happen in every bonus game. In one embodiment, the gaming device causes the display device 30 to reveal the highest offer 602 and the lowest offer 604 associated with the masked selections 606 as illustrated in FIG. 7A. A number of masked selections 606 are also displayed to a player. In this embodiment, a number of values 610 associated with a number of masked selections 606 are revealed to the player. The values 610 fade in and fade out, so that the player can determine the values 610 associated with a number of the masked selections 606 as illustrated in FIG. 7B. This production can create the illusion that the gaming device 10 is broken. The masked selections 606 are then displayed and the player is asked to pick a selection 612 as illustrated in FIG. 7C.

In another embodiment, the values, when revealed to a player, flicker in and out to create an illusion to the player that the gaming device 10 is broken.

It should be appreciated that there are other ways to simulate the gaming device 10 being broken and revealing the values associated with the selections in the bonus game.

In one embodiment of the present invention, when a player achieves an indicator trigger or predetermined condition, the player is awarded the indicator and also a masked selection or a number of masked selections are displayed to the player. At that time, the values associated with the masked selection or masked selections are also revealed to the player. If a player achieves a bonus game trigger or qualifying condition, the plurality of masked selections are displayed to the player including the masked selections previously displayed. The player is allowed to pick at least one of the masked selections and is awarded the awards associated with the picked selections.

It should be appreciated that the values associated with the indicators can be in random order or increase in value as the player's achieves the indicator triggers.

It should be appreciated that the presentation of the present invention can vary, in one embodiment of the present invention, the gaming device 10 has animation which displays the indicators as playing cards which are dealt to the player when an indicator trigger in the primary game is achieved. The value of the cards are displayed to the player either in the primary game or during the bonus game. Animation displaying that the player has a full hand initiates the bonus game. During the bonus game the player picks a card and is awarded the value associated with that selection.

While the present invention is described in connection with what is presently considered to be the most practical and preferred embodiments, it should be appreciated that the present invention is not limited to the disclosed embodiments, and is intended to cover various modifications and equivalent arrangements included within the spirit and scope of the claims. Modifications and variations in the present invention may be made without departing from the novel aspects of the invention as defined in the claims and this application is limited only by the scope of the claims.

The invention is claimed as follows:

1. A gaming device comprising:

at least one input device;

at least one display device;

at least one processor; and at least one memory device which stores a plurality of instructions, which when executed by the at least one processor, cause the at least one processor to operate with the at least one input device and the at least one display device to control each play of a game by:

(a) causing a plurality of masked selections to be displayed to a player, said plurality of masked selections associated with a plurality of awards including a largest award, each of said awards associated with at least one of said masked selections, (b) unmasking at least one of said masked selections to reveal to the player the award associated with said at least one of the masked selections before enabling the player to pick any of the masked selections to inform the player that said award is associated with said selection for said play of the game, wherein one of the selections which is unmasked includes said masked selection associated with the largest award, (c) enabling the player to pick at least one of the masked selections, and (d) providing the player with at least one award associated with the player picked masked selection or selections, wherein the award provided to the player is determined after said player picks the masked selections, and wherein the award provided to the player does not have to be the displayed largest award.

2. The gaming device of claim 1, which includes an animation which reveals to the player the award associated with a predetermined one of the masked selections, wherein if, after said processor enables the player to pick at least one of the masked selections, the player does not pick said predetermined one of the masked selections, the processor is programmed to cause the display device to display the animation and enable the player to pick again.

3. The gaming device of claim 1, wherein if said player does not pick the masked selection associated with said largest award, the processor is programmed to enable the player to pick again.

4. The gaming device of claim 1, wherein at least one of the awards is not revealed to the player prior to enabling the player to pick at least one of the masked selections.

5. The gaming device of claim 1, wherein said processor is programmed to reveal the award associated with the at least one of the masked selections in a manner which gives an illusion that the gaming device is broken.

* * * * *

UNITED STATES PATENT AND TRADEMARK OFFICE

CERTIFICATE OF CORRECTION

PATENT NO. : 7,413,508 B2
APPLICATION NO. : 10/466517
DATED : August 19, 2008
INVENTOR(S) : Dwayne Nelson et al.

It is certified that error appears in the above-identified patent and that said Letters Patent is hereby corrected as shown below:

Title Page, item [56] col. 1, line 1

In U.S. Patent Documents change "1,527,929 A 2/1925 Simons" to --1,527,929 A 2/1925 D.G. Simons".

In Other Publications page 2, insert --Ripley's Believe It Or Not Article, published by Strictly Slots, June 2001--.

Signed and Sealed this

Thirtieth Day of December, 2008

JON W. DUDAS
*Director of the United States Patent and Trademark Office*

UNITED STATES PATENT AND TRADEMARK OFFICE

CERTIFICATE OF CORRECTION

PATENT NO. : 7,413,508 B2
APPLICATION NO. : 10/446517
DATED : August 19, 2008
INVENTOR(S) : Dwayne Nelson et al.

It is certified that error appears in the above-identified patent and that said Letters Patent is hereby corrected as shown below:

Title Page, item [56] col. 1, line 1

In U.S. Patent Documents change "1,527,929 A 2/1925 Simons" to --1,527,929 A 2/1925 D.G. Simons--.

In Other Publications page 2, insert --Ripley's Believe It Or Not Article, published by Strictly Slots, June 2001--.

This certificate supersedes the Certificate of Correction issued December 30, 2008.

Signed and Sealed this

Fifteenth Day of December, 2009

David J. Kappos

David J. Kappos
*Director of the United States Patent and Trademark Office*